US007686657B1

(12) United States Patent
Chan et al.

(10) Patent No.: US 7,686,657 B1
(45) Date of Patent: Mar. 30, 2010

(54) CIGARETTE LIGHTER ADAPTER WITH USB CONNECTOR

(75) Inventors: Wen Yao Chan, Shulin (TW); Wen Yang Yang, Shulin (TW); Shih Wei Chuang, Shulin (TW)

(73) Assignee: L & K Precision Technology Co., Ltd., Shulin, Taipei County (TW)

( * ) Notice: Subject to any disclaimer, the term of this patent is extended or adjusted under 35 U.S.C. 154(b) by 0 days.

(21) Appl. No.: 12/385,682

(22) Filed: Apr. 16, 2009

(51) Int. Cl.
*H01R 13/64* (2006.01)

(52) U.S. Cl. ..... 439/668

(58) Field of Classification Search ..... 439/668, 439/669

See application file for complete search history.

(56) References Cited

U.S. PATENT DOCUMENTS

| | | | | |
|---|---|---|---|---|
| 4,109,988 | A * | 8/1978 | Olson | 439/265 |
| 4,248,494 | A * | 2/1981 | McDonald et al. | 439/638 |
| 4,789,361 | A * | 12/1988 | Kinzalow et al. | 439/620.29 |
| 5,007,863 | A * | 4/1991 | Xuan | 439/639 |
| 5,199,904 | A * | 4/1993 | Wharton | 439/668 |
| 5,860,824 | A * | 1/1999 | Fan | 439/265 |
| 6,394,851 | B1 * | 5/2002 | Paciorek | 439/668 |
| 6,478,628 | B1 * | 11/2002 | Ming | 439/668 |
| 6,612,875 | B1 * | 9/2003 | Liao | 439/675 |
| 6,855,003 | B1 * | 2/2005 | Wyant | 439/502 |
| 7,066,767 | B2 * | 6/2006 | Liao | 439/639 |
| 7,258,580 | B1 * | 8/2007 | Ho et al. | 439/668 |
| D559,266 | S * | 1/2008 | Oh | D14/496 |
| 7,351,111 | B2 * | 4/2008 | Cheng | 439/638 |
| 7,500,881 | B1 * | 3/2009 | Lin | 439/668 |
| 2002/0119708 | A1 * | 8/2002 | Eisenbraun | 439/668 |

* cited by examiner

*Primary Examiner*—T C Patel
*Assistant Examiner*—Vladimir Imas
(74) *Attorney, Agent, or Firm*—Cheng-Ju Chiang

(57) ABSTRACT

A cigarette lighter adapter with USB connector, includes a first casing engagable with a second casing, the first and the second casings cooperatively defining a plug portion and a holding portion, a circuit board, a contact terminal, a fixed spring contact, a USB connector having an insertion opening, a rotating means, and a transmission wire electrically connected to the circuit board, wherein a sleeve having a plug hole corresponding to the insertion opening is mounted to the engaged first and the second casings and is able to rotate about the holding portion by means of the rotating means to locate the plug hole facing the insertion opening in an insertion position or to shield the insertion opening, whereby to protect the USB connector and keep dust out of the USB connector.

6 Claims, 5 Drawing Sheets

CIGARETTE LIGHTER ADAPTER WITH USB CONNECTOR

BACKGROUND OF THE INVENTION

1. Field of the Invention

The present invention relates to a cigarette lighter adapter, and particularly to a cigarette lighter adapter with USB connector being selectively shielded.

2. Related Art

A cigarette lighter socket is usually equipped on a front panel of a car for being mated with a cigarette lighter adapter for lighting cigarettes. The cigarette lighter adapter can also be modified to receive current from the cigarette lighter socket and transmit the power through a transmitting wire to connected appliances such as car used vacuum cleaners, air compressors, cell phones, or chargers. In recent years, USB interface has been used widely and commonly on most electrical products for transmitting data therebetween; consequently, the cigarette lighter adapter is developed to have a USB connector so as to electrically connect those electrical products through the USB transmitting wire; therefore, the cigarette lighter adapter is improved to be multi-functional and electrical products are to be used more convenient in car.

However, when the cigarette lighter adapter is not in use, a plug opening of the USB connector is thoroughly exposed to outside of the cigarette lighter adapter that causes dust or other objects to get into the inside of the USB connector and therefore obstruct the plug hole leading to an unstable transmitting.

SUMMARY OF THE INVENTION

Accordingly, an object of the present invention is to provide a cigarette lighter adapter with USB connector in which the USB connector is selectively shielded so that to be protected and dust-proof.

To achieve the above mentioned object, the cigarette lighter adapter with USB connector includes a first casing engagable with a second casing, the first and the second casings cooperatively defining a plug portion and a holding portion, a circuit board, a contact terminal, a fixed spring contact, a USB connector having an insertion opening, a rotating means, and a transmission wire electrically connected to the circuit board, wherein a sleeve having a plug hole corresponding to the insertion opening is mounted to the engaged first and the second casings and is able to rotate about the holding portion by means of the rotating means to locate the plug hole facing the insertion opening in an insertion position or to shield the insertion opening.

DESCRIPTION OF THE PREFERRED EMBODIMENTS

Figure 1:
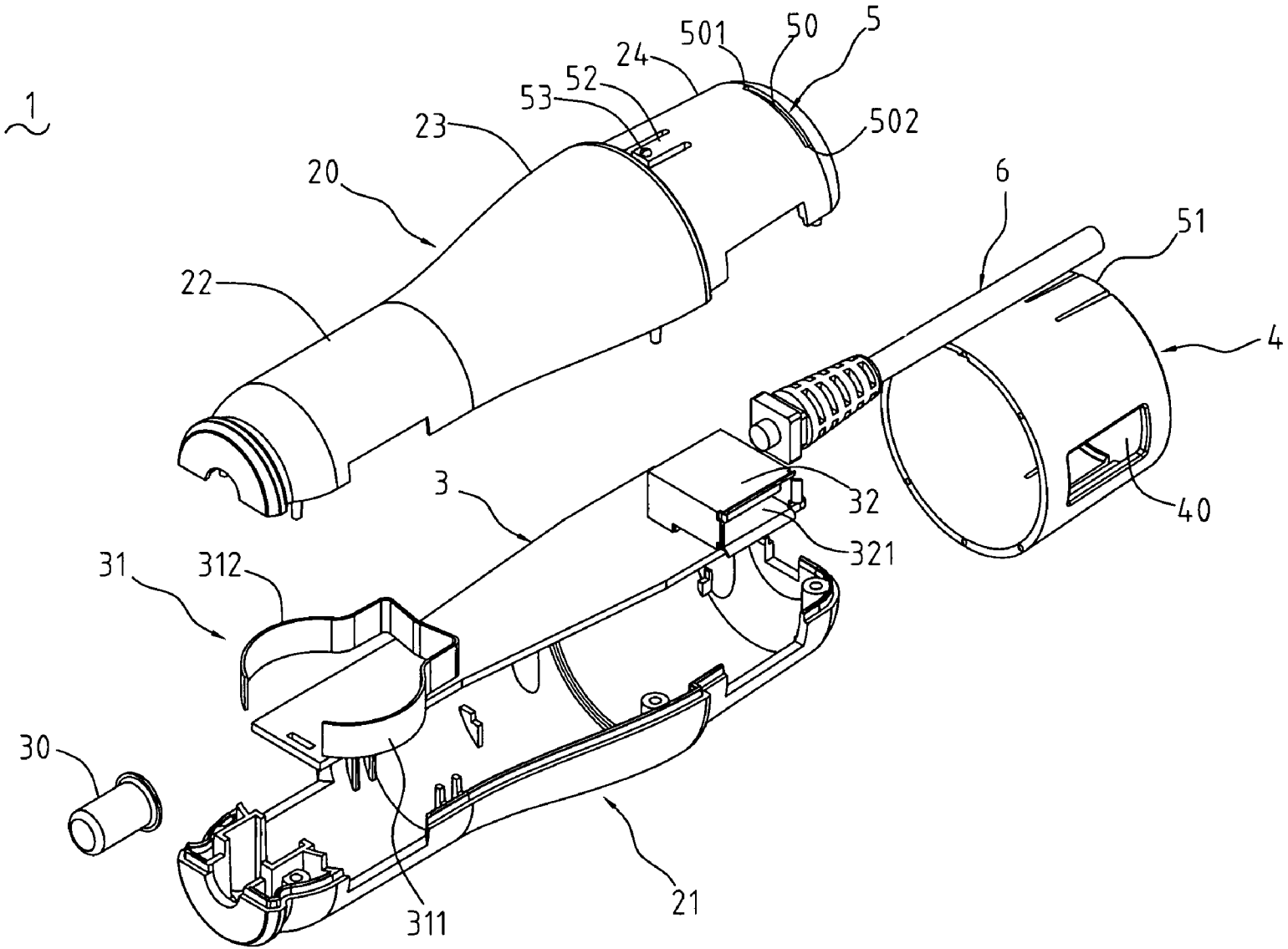
FIG. 1 is an exploded perspective view of a cigarette lighter adapter with USB connector of the present invention.

Referring to FIG. 1, a cigarette lighter adapter with USB connector 1 of the present invention includes: a first casing 20 and a second casing 21, a circuit board 3, a sleeve 4, a rotating means 5, and a transmission wire 6, wherein the first and the second casings 20, 21 are engageable with each other to be integrated and made of nonmetal material, the first casing 20 engaged with the second casings 21 cooperatively defining a plug portion 22 and a holding portion 23, the plug portion 22 being plugged into a cigarette lighter socket (not shown) in a car. The holding portion 23 further forms a recess 24 for being fitted to the sleeve 4 such that the sleeve 4 is flush with adjoining edges of the first and the second casings 20, 21 of the holding portion 23.

The circuit board 3 is accommodated within the engaged first casing 20 and the second casing 21, wherein a contact terminal 30, a fixed spring contact 31 and a USB connector 32 are electrically connected with the circuit board 3. Further referring to FIG. 1 in combination with FIG. 2, in assembly, the contact terminal 30 is located at the plug portion 22 with a part thereof out of a front side of the plug portion 22 for electrically connecting the cigarette lighter socket, the fixed spring contact 31 having two spaced-apart spring plates 311, 312 being arc-shaped, parts of the spring plates 311, 312 being out of opposite sides of the plug portion 22 and engaged against walls of the cigarette lighter socket, the USB connector 32 disposed on one end of the circuit board 3 with respect to the holding portion 23. One end of the transmission wire 6 is connected with the circuit board 3 and another end thereof is connected with a plug connector (not shown) or a socket connector (not shown).

The sleeve 4 is hollow therein with two openings (not labeled) at opposite ends thereof and is mounted to the recess 24 of the holding portion 23, the sleeve 4 having a plug hole 40 corresponding to an insertion opening 321 of the USB connector 32.

Figure 2:
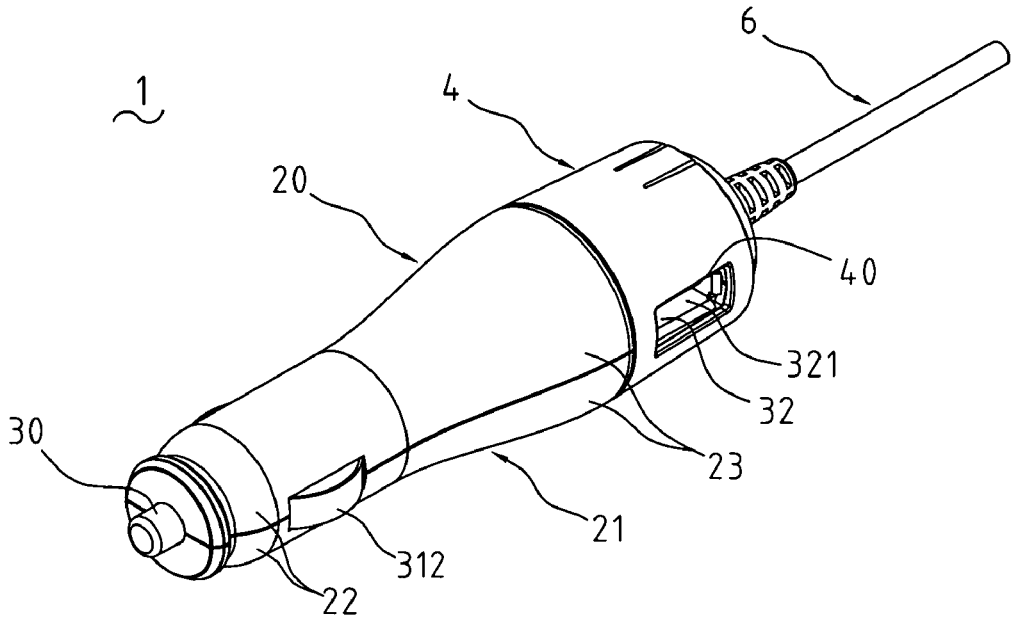
FIG. 2 is an assembly perspective view of FIG. 1.
Figure 3:
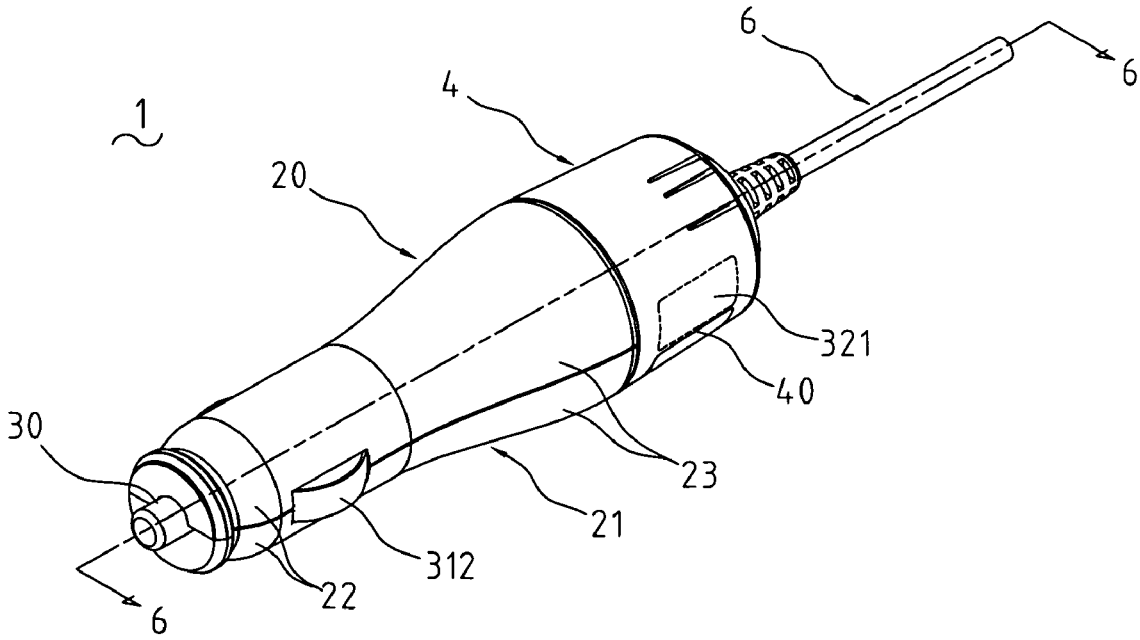
FIG. 3 is a perspective view showing an insertion opening of the USB connector is shield.
Figure 4A:
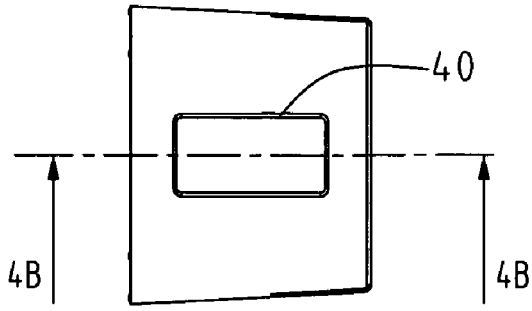
FIG. 4A is a front elevational view of a sleeve of the present invention.
Figure 4B:
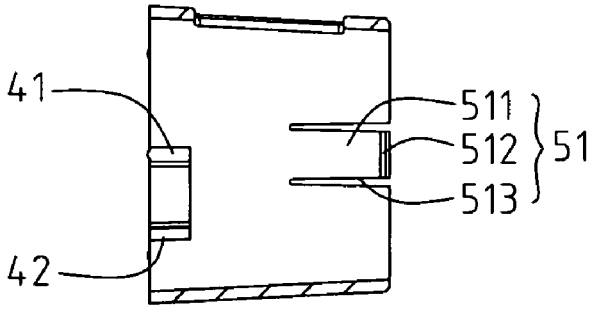
FIG. 4B is a cross-sectional view taken along line 4A-4B in FIG. 4A.
Figure 4C:
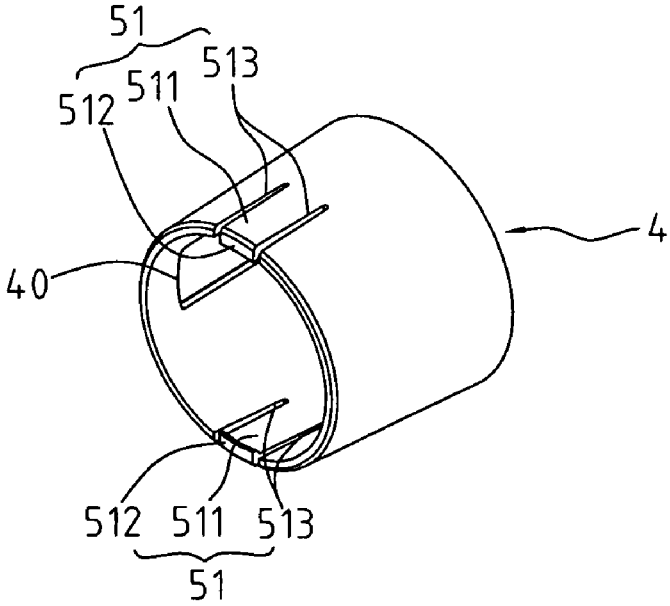
FIG. 4C is a perspective view of the sleeve of the present invention.
Figure 5A:
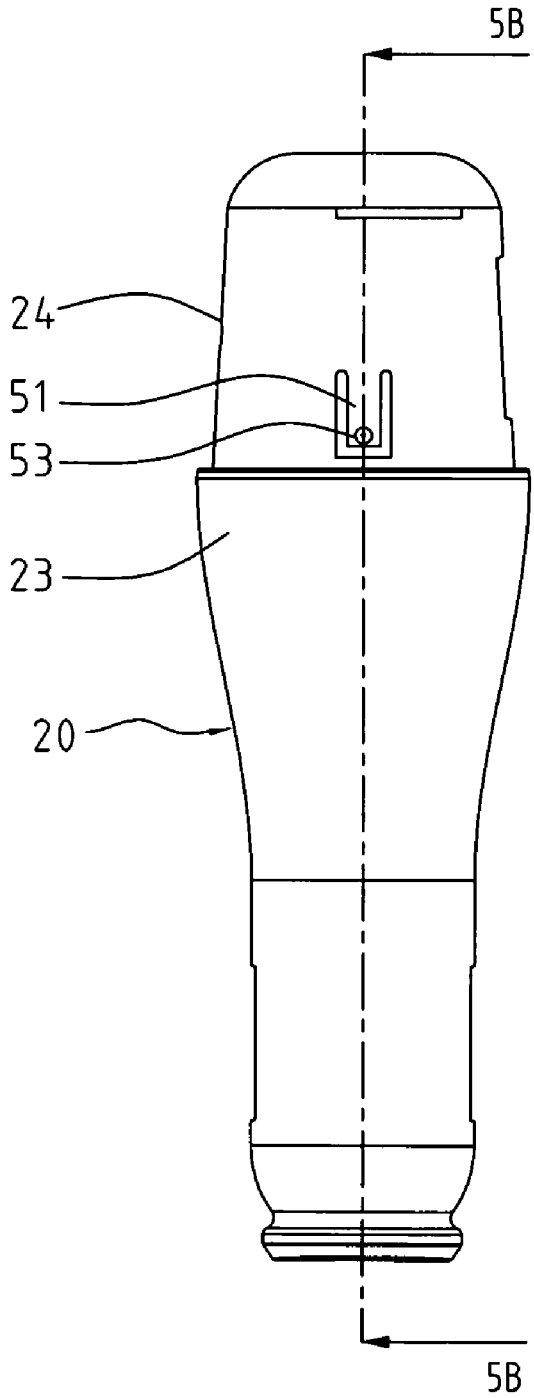
FIG. 5A is a front elevational view of a first casing of the present invention.
Figure 5B:
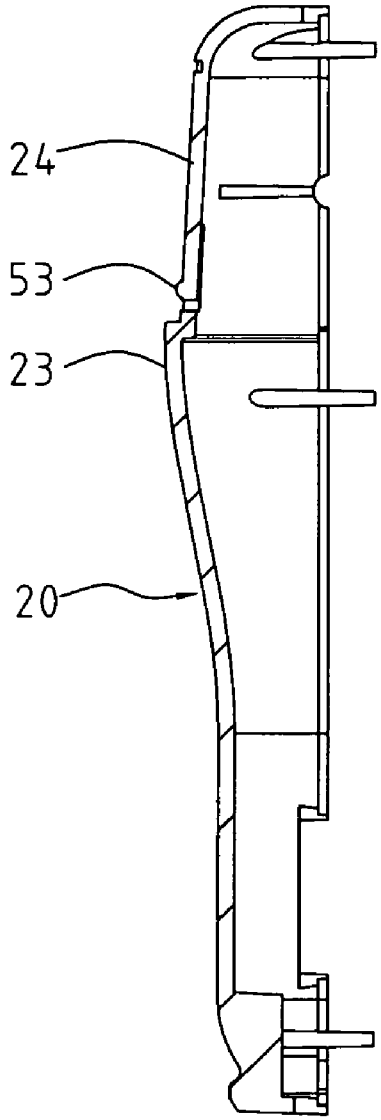
FIG. 5B is a cross-sectional view taken along line 5B-5B in FIG. 5A.
Figure 6:
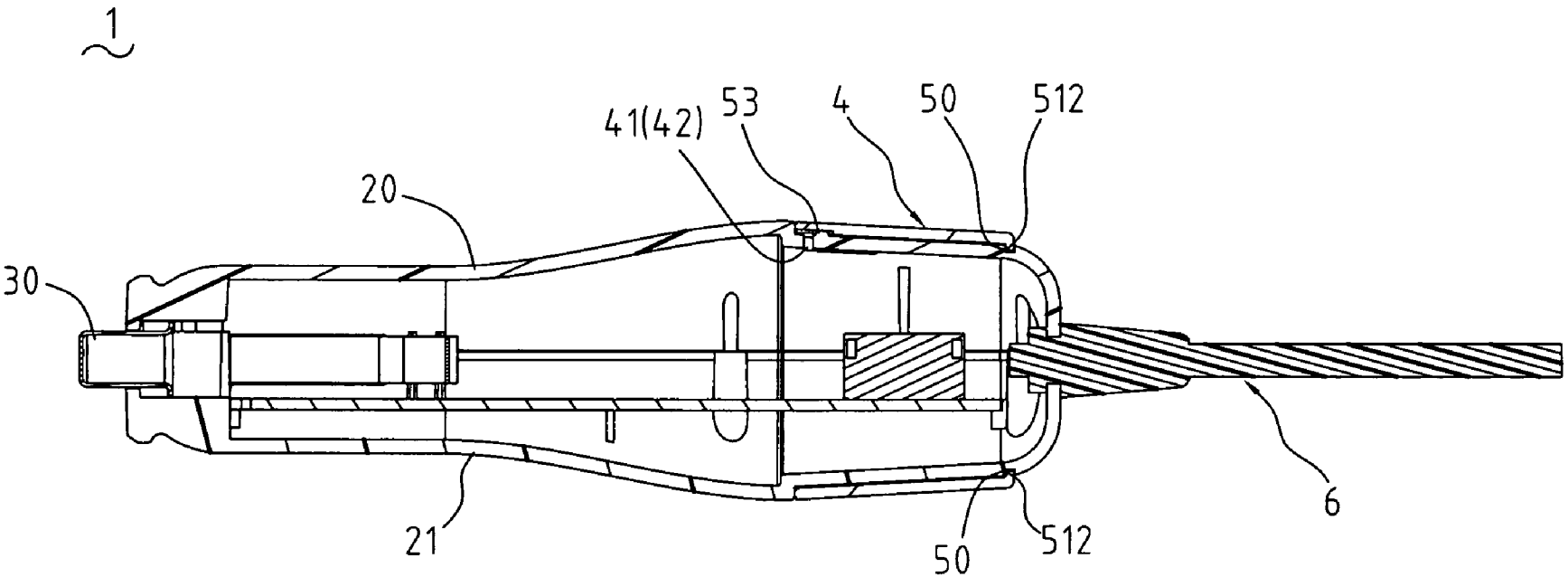
FIG. 6 is a cross-sectional view taken along line 6-6 in FIG. 3.

The rotating means 5 is disposed on and between the sleeve 4 and the engaged first and second casings 20, 21, and enables the sleeve 4 to rotate about the recess 24 so as to locate the plug hole 40 of the sleeve 4 facing the insertion opening 321 of the USB connector 32 in an insertable position (as shown in FIG. 2) or to shield the insertion opening (as shown in FIG. 3). The rotating means 5 includes: a pair of slots 50 and guiding bars 51, each of the guiding bars 51 having a cantilever 511 and a protrusion 512. The pair of slots 50 are respectively formed on the first casing 20 and the second casing 21 and located at an end edge of the holding portion 23, wherein length of each of the slots 50 allows the protrusion 512 of the guiding bar 51 to rotatably slide within a range of 35 degrees with respect to the USB connector 32. Referring to FIGS. 4A to 4C, the pair of guiding bars 51 are disposed on the sleeve 4, the cantilever 511 formed by two slits 513 spaced apart from each other so that a free end of the slit 513 is flexible. The protrusion 512 protrudes from a bottom of the free end of the cantilever 511 and is in contact with the respective slot 50 after assembling. Referring to FIG. 6, the sleeve 4 rotates about the recess 24 with the protrusion 512 sliding on the slot 50. When the protrusion 512 slides to a first position 501, the plug hole 40 of the sleeve 4 is facing the insertion opening 321 of the USB connector 32 in an insertion position. On the contrary, when the protrusion 512 slides to a second position 502, the plug hole 40 is away from the insertion opening 321 and therefore the insertions opening 321 is shield by the sleeve 4 (as hidden lines shown in FIG. 3). Consequently, dust or other objects are kept out of the USB connector 32 by the sleeve 4, whereby the USB connector 32 is well protected and data transmitting is reliable.

Furthermore, referring to FIGS. 4B and 5A to 6, a pair of engaged arms 52 are respectively integrally formed on the first casing 20 and the second casing 21 and located at an end of the recess 24 of the holding portion 23 opposite to the slots 50, each of the engaged arms 52 having a hump 53 at a free end thereof, and the sleeve 4 further includes a first groove 41 and a second groove 42. When the sleeve 4 rotates to the first position 501 or the second position 502, the first groove 41 or the second groove 42 is engaged against the hump 53 to locate the sleeve 4 (as shown in FIG. 6).

It is understood that the invention may be embodied in other forms without departing from the spirit thereof. Thus, the present examples and embodiments are to be considered in all respects as illustrative and not restrictive, and the invention is not to be limited to the details given herein.

What is claimed is:

1. A cigarette lighter adapter with USB connector being insertable to a cigarette lighter socket, comprising:

a first casing and second casing engageable with the first casing, the first and second casings made of nonmetal material and cooperatively defining a plug portion and a holding portion;

a circuit board accommodated within the engaged first casing and the second casing, the circuit board electrically connected with a contact terminal, a fixed spring contact and a USB connector, the contact terminal located at the plug portion with a part thereof out of a front side of the plug portion, the fixed spring contact including two spaced-apart spring plates being arc-shaped and partially out of opposite sides of the plug portion, and the USB connector disposed on one end of the circuit board with respect to the holding portion;

a sleeve being hollow therein with two openings at opposite ends thereof and mounted to the holding portion, the sleeve having a plug hole corresponding to an insertion opening of the USB connector; and a rotating means disposed on and between the sleeve and the engaged first and second casings, the rotating means enabling the sleeve to rotate about the holding portion so as to locate the plug hole of the sleeve facing the insertion opening of the USB connector in an insertable position or to shield the insertion opening.

2. The cigarette lighter adapter with USB connector as claimed in claim 1, wherein the rotating means comprises a pair of slots and guiding bars, wherein the pair of slots are respectively formed on the first casing and the second casing and located at an end edge of the holding portion, and the pair of guiding bars are disposed on the sleeve, each of the guiding bars having a cantilever and a protrusion, the cantilever formed by two slits spaced apart from each other, the protrusion protruding from a bottom of a free end of the cantilever for rotatably sliding on the respective slot to reach a first position or a second position.

3. The cigarette lighter adapter with USB connector as claimed in claim 2, wherein a pair of engaged arms are respectively integrally formed on the first casing and the second casing and located at an end of the holding portion opposite to the slots, each of the engaged arms having a hump at a free end thereof, the sleeve further including a first groove and a second groove for being engaged against the hump to locate the sleeve while the sleeve is rotated to the first position and the second position.

4. The cigarette lighter adapter with USB connector as claimed in claim 3, wherein length of the slot allows the protrusion of the guiding bar to rotatably slide within a range of 35 degrees with respect to the USB connector.

5. The cigarette lighter adapter with USB connector as claimed in claim 1, further comprising a transmission wire of which one end is connected with the circuit board and another end is connected with a plug connector or a socket connector.

6. The cigarette lighter adapter with USB connector as claimed in claim 1, wherein the holding portion further forms a recess for being fitted to the sleeve such that the sleeve is flush with adjoining edges of the holding portion.

* * * * *